US008299989B2

(12) United States Patent
Liu

(10) Patent No.: US 8,299,989 B2
(45) Date of Patent: Oct. 30, 2012

(54) ELECTRONIC SYSTEM INCLUDING PIXEL UNITS WITH SHIFTED OPERATING VOLTAGES

(75) Inventor: Ping-Lin Liu, Tainan (TW)

(73) Assignee: Chimei Innolux Corporation, Chu-Nan (TW)

( * ) Notice: Subject to any disclaimer, the term of this patent is extended or adjusted under 35 U.S.C. 154(b) by 465 days.

(21) Appl. No.: 12/552,559

(22) Filed: Sep. 2, 2009

(65) Prior Publication Data

US 2010/0053143 A1 Mar. 4, 2010

(30) Foreign Application Priority Data

Sep. 4, 2008 (TW) ..... 97133894 A

(51) Int. Cl.
*G09G 3/30* (2006.01)

(52) U.S. Cl. ..... 345/82

(58) Field of Classification Search ..... 345/76, 345/77, 82, 211
See application file for complete search history.

(56) References Cited

U.S. PATENT DOCUMENTS

| | | | | |
|---|---|---|---|---|
| 7,408,533 | B2 * | 8/2008 | Eom et al. | 345/76 |
| 7,864,140 | B2 * | 1/2011 | Kim et al. | 345/77 |
| 7,893,897 | B2 * | 2/2011 | Chung et al. | 345/82 |
| 2008/0174287 | A1 * | 7/2008 | Park | 323/271 |

* cited by examiner

*Primary Examiner* — Chanh Nguyen
*Assistant Examiner* — Kwang-Su Yang
(74) *Attorney, Agent, or Firm* — Liu & Liu

(57) ABSTRACT

A system for displaying image is provided. The system includes a pixel unit coupled to a source driver and including a first switch, a second switch, a first capacitor, a second capacitor, a driving transistor, and a luminiferous device. The first switch includes a first control terminal receiving a first scan signal, a first terminal receiving a first operation voltage, and a second terminal. The second switch includes a second control terminal receiving a second scan signal, a third terminal, and a fourth terminal coupled to the source driver. The first capacitor is coupled between the first and the second terminals. The second capacitor is coupled between the second and the third terminals. The driving transistor includes a gate coupled to the second terminal, a source receiving the first operation voltage, and a drain. The luminiferous device is coupled to the drain and receiving a second operation voltage.

16 Claims, 8 Drawing Sheets

ELECTRONIC SYSTEM INCLUDING PIXEL UNITS WITH SHIFTED OPERATING VOLTAGES

CROSS REFERENCE TO RELATED APPLICATIONS

This Application claims priority of Taiwan Patent Application No. 97133894, filed on Sep. 4, 2008, the entirety of which is incorporated by reference herein.

BACKGROUND OF THE INVENTION

1. Field of the Invention

The invention relates to a pixel unit, and more particularly to a pixel unit that does not be affected when an operation voltage is shifted.

2. Description of the Related Art

Because cathode ray tubes (CRTs) are inexpensive and provide high definition, they are utilized extensively in televisions and computers. With technological development, new flat-panel displays are continually being developed. When a larger display panel is required, the weight of the flat-panel display does not substantially change when compared to CRT displays. Generally, flat-panel displays comprises liquid crystal displays (LCD), plasma display panels (PDP), field emission displays (FED), and electroluminescent (EL) displays.

FIG. 1 is a schematic diagram of a conventional pixel unit. The pixel unit 100 comprises transistors 110 and 130, a capacitor 120, and a luminiferous device 140. When the transistor 110 is turned on by a scan signal SCAN, the capacitor 120 stores charge according to a data signal DATA. The transistor 130 provides a driving current to the luminiferous device 140 according to the stored charge. The intensity of the light, which emitted by the luminiferous device 140, relates to the amount of the driving current.

Generally, a power line is utilized such that pixel units receive an operation voltage PVDD. When the size of a display panel is increased, the length of the power line is also increased. Thus, the parasitical resistor of the power line is increased such that a voltage difference between two terminals of the power line is increased. For example, the voltage in one terminal of the power line maybe 5V and the voltage in another terminal of the power line maybe 4.5V due to the parasitical resistor of the power line. Since the driving current provided by the transistor 130 relates to the operation voltage PVDD, when the operation voltage PVDD is shifted, the driving current is affected. Thus, the intensity of the light, which emitted by the luminiferous device 140, is inaccurate.

BRIEF SUMMARY OF THE INVENTION

Pixel units are provided. An exemplary embodiment of a pixel unit, which is coupled to a source driver, comprises a first switch, a second switch, a first capacitor, a second capacitor, a driving transistor, and a luminiferous device. The first switch comprises a first control terminal receiving a first scan signal, a first terminal receiving a first operation voltage, and a second terminal. The second switch comprises a second control terminal receiving a second scan signal, a third terminal, and a fourth terminal coupled to the source driver. The first capacitor is coupled between the first and the second terminals. The second capacitor is coupled between the second and the third terminals. The driving transistor comprises a gate coupled to the second terminal, a source receiving the first operation voltage, and a drain. The luminiferous device is coupled to the drain and receiving a second operation voltage.

Display panels are provided. An exemplary embodiment of a display panel comprises a gate driver, a source driver, and a pixel unit. The gate driver provides a first scan signal and a second scan signal. The source driver provides a data signal or a reference signal and comprises a data unit and a control unit. The data unit provides the data signal. The control unit provides the reference signal, a switching signal and a clock signal. The pixel unit comprises a first switch, a second switch, a first capacitor, a second capacitor, a driving transistor, and a luminiferous device. The first switch comprises a first control terminal receiving the first scan signal, a first terminal receiving a first operation voltage, and a second terminal. The second switch comprises a second control terminal receiving the second scan signal, a third terminal, and a fourth terminal coupled to the source driver. The first capacitor is coupled between the first and the second terminals. The second capacitor is coupled between the second and the third terminals. The driving transistor comprises a gate coupled to the second terminal, a source receiving the first operation voltage, and a drain. The luminiferous device is coupled to the drain and receiving a second operation voltage.

Electronic systems are also provided. An exemplary embodiment of an electronic system comprises a power transformation module and a display panel. The power transformation module transforms an external power into a first operation voltage and a second operation voltage. The display panel receives the first and the second operation voltages and comprises a gate driver, a source driver, and a pixel unit. The gate driver provides a first scan signal and a second scan signal. The source driver provides a data signal or a reference signal and comprises a data unit and a control unit. The data unit provides the data signal. The control unit provides the reference signal, a switching signal and a clock signal. The pixel unit comprises a first switch, a second switch, a first capacitor, a second capacitor, a driving transistor, and a luminiferous device. The first switch comprises a first control terminal receiving the first scan signal, a first terminal receiving the first operation voltage, and a second terminal. The second switch comprises a second control terminal receiving the second scan signal, a third terminal, and a fourth terminal coupled to the source driver. The first capacitor is coupled between the first and the second terminals. The second capacitor is coupled between the second and the third terminals. The driving transistor comprises a gate coupled to the second terminal, a source receiving the first operation voltage, and a drain. The luminiferous device is coupled to the drain and receiving the second operation voltage.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
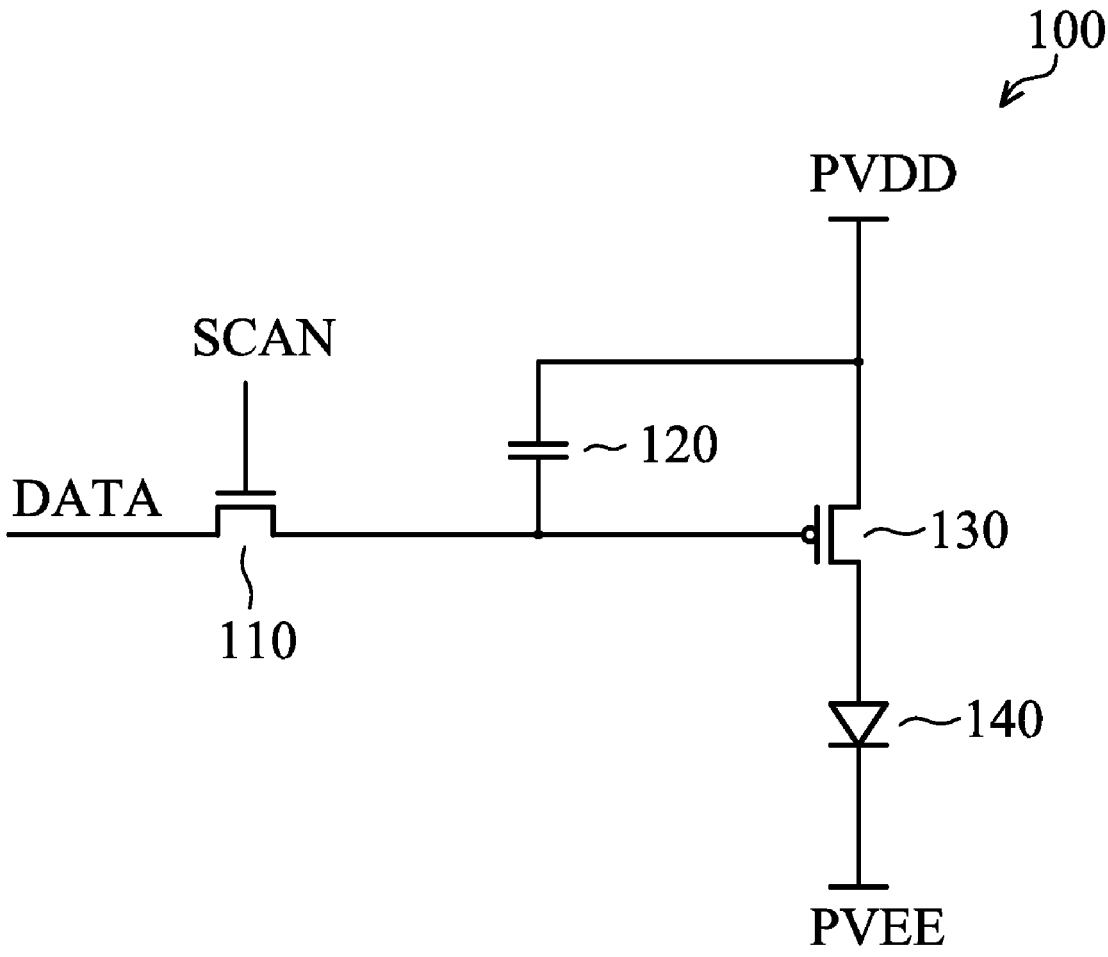
FIG. 1 ( PRIOR ART )
FIG. 1 is a schematic diagram of a conventional pixel unit.
Figure 2:
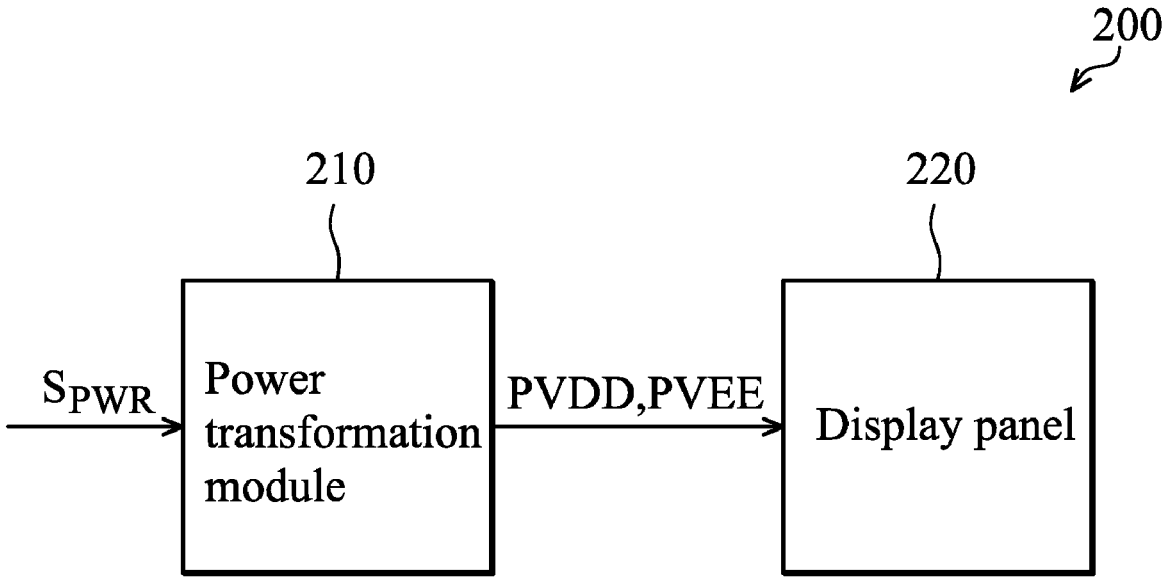
FIG. 2 is a schematic diagram of an exemplary embodiment of an electronic system.

FIG. 2 is a schematic diagram of an exemplary embodiment of an electronic system. The electronic system 200 maybe a personal digital assistant (PDA), a cellular phone, a digital camera (DSC), a television, a global positioning system (GPS), a car display, an avionics display, a digital photo frame, a notebook computer (NB), or a personal computer (PC). Referring to FIG. 2, the electronic system 200 comprises a power transformation module 210 and a display panel 220. The power transformation module 210 transforms an external power $S_{PWR}$ into operation voltages PVDD and PVEE. The display panel 220 receives the operation voltages PVDD and PVEE and displays images.

In one embodiment, the power transformation module 210 is a DC-DC converter to transform the level of the external power $S_{PWR}$. In another embodiment, the power transformation module 210 is an AC-DC converter to transform the external power $S_{PWR}$ from AC format to DC format.

Figure 3A:
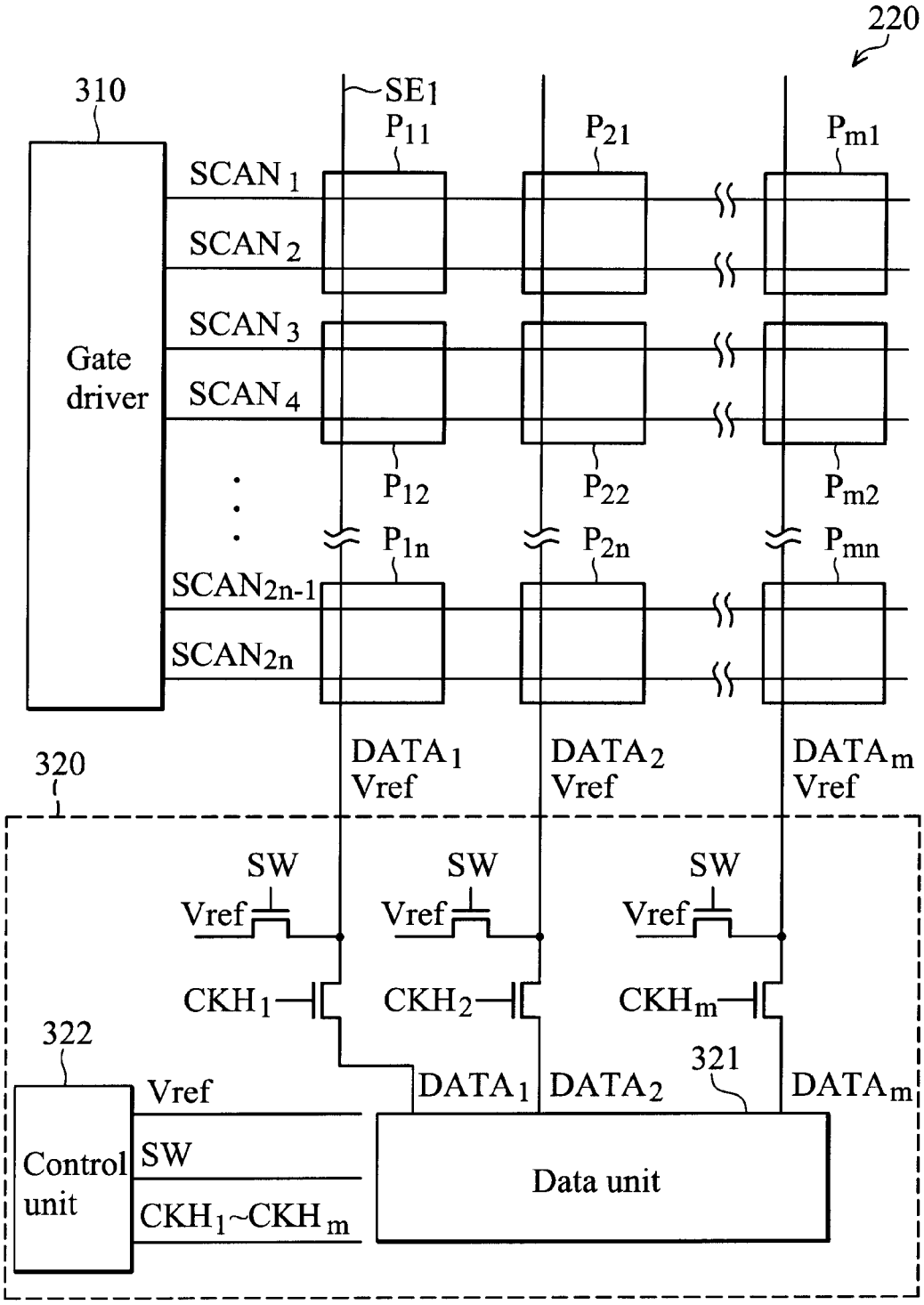
FIG. 3*a* is a schematic diagram of an exemplary embodiment of a display panel.

FIG. 3*a* is a schematic diagram of an exemplary embodiment of a display panel. The display panel 220 comprises a gate driver 310, a source driver 320, and pixel units P11~Pmn. The gate driver 310 provides scan signals SCAN1~SCAN2*n* to the pixel units P11~Pmn via gate lines. The source driver 320 provides data signals DATA1~DATAm or a reference signal Vref to the pixel units P11~Pmn via data lines.

The source driver 320 can utilize one or the different metal lines to provide data signal or the reference signal to the pixel units in the same column (vertical direction). As shown in FIG. 3*a*, the source driver 320 utilizes one metal line to provide data signal or the reference signal to the pixel units in the same column. For example, the source driver 320 utilizes the data line $SE_1$ to provides the data signal $DATA_1$ or the reference signal Vref to the pixel units (such as $P_{11}, P_{12}, \ldots, P_{1n}$) in the first column.

Additionally, FIG. 3*a* shows an embodiment of the source driver 320, but the disclosure is not limited thereto. In this embodiment, the source driver 320 comprises a data unit 321 and a control unit 322. The data unit 321 provides data signals $DATA_1$~$DATA_m$. The control unit 322 provides the reference signal Vref, a switching signal SW, and clock signals $CKH_1$~$CKH_m$. The source driver 320 provides the data signals $DATA_1$~$DATA_m$ or the reference signal Vref to the pixel units $P_{11}$~$P_{mn}$ according to the switching signal SW and clock signals $CKH_1$~$CKH_m$ (described in more detail later).

Figure 3B:
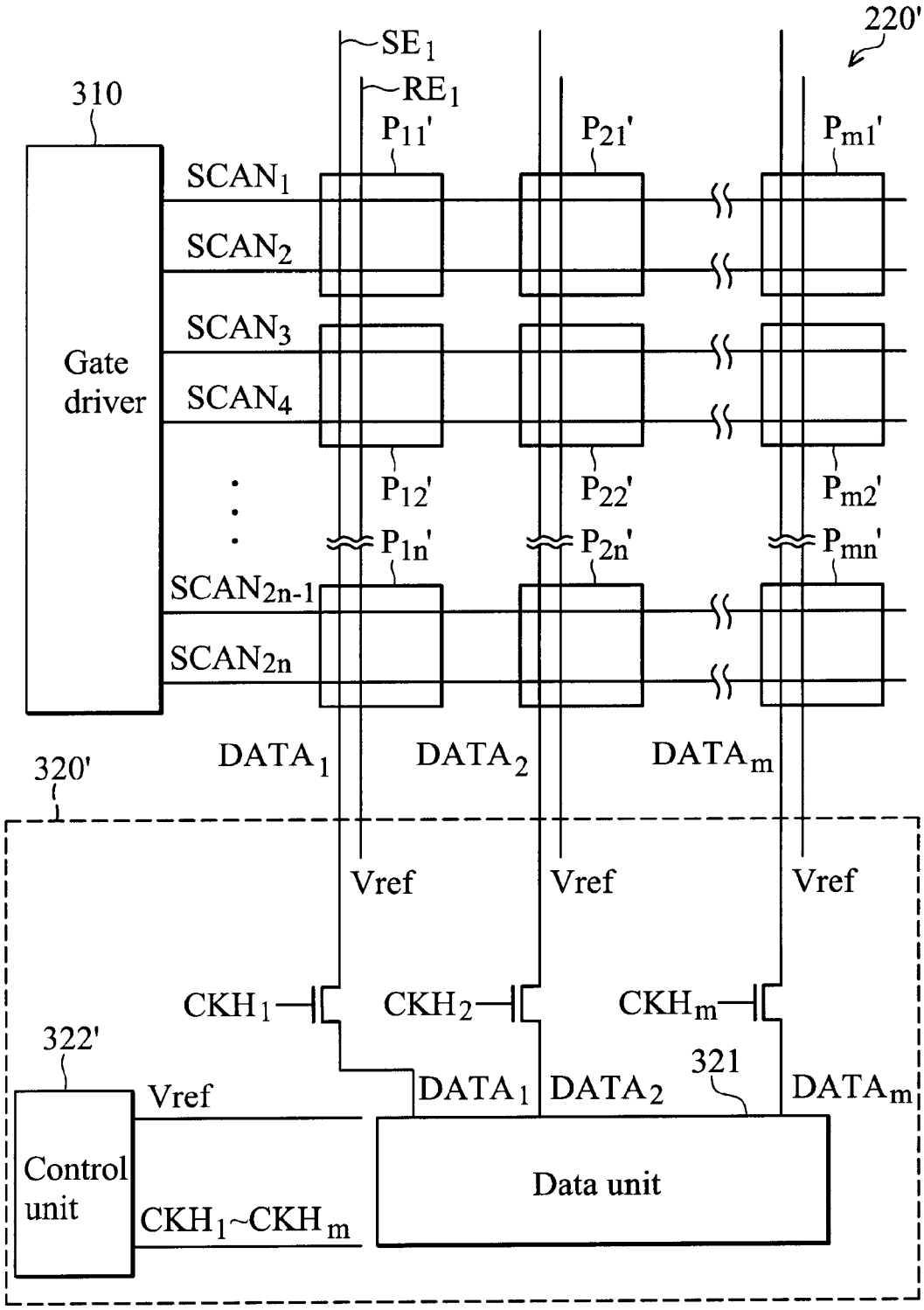
FIG. 3*b* is a schematic diagram of another exemplary embodiment of the display panel.

FIG. 3*b* is a schematic diagram of another exemplary embodiment of the display panel. In this embodiment, the source driver 320' transmits the reference signal Vref to the pixel units via another metal line. In other words, the source driver 320' transmits the data signal $DATA_1$ to the pixel units (such as $P_{11}, P_{12}, \ldots, P_{1n}$) in the first column via the data line $SE_1$ and transmits the reference signal Vref to the pixel units in the first column via the reference metal line $RE_1$.

Similarly, the embodiment shown in FIG. 3*b* is not limited. In this embodiment, the source driver 320' comprises a data unit 321 and a control unit 322'. The data unit 321 provides data signals $DATA_1$~$DATA_m$. The control unit 322' provides a reference signal Vref and clock signals $CKH_1$~$CKH_m$. The source driver 320' provides the data signals $DATA_1$~$DATA_m$ or the reference signal Vref to the pixel units $P_{11}$~$P_{mn}$ according to the clock signals $CKH_1$~$CKH_m$ (described in more detail later).

Figure 4A:
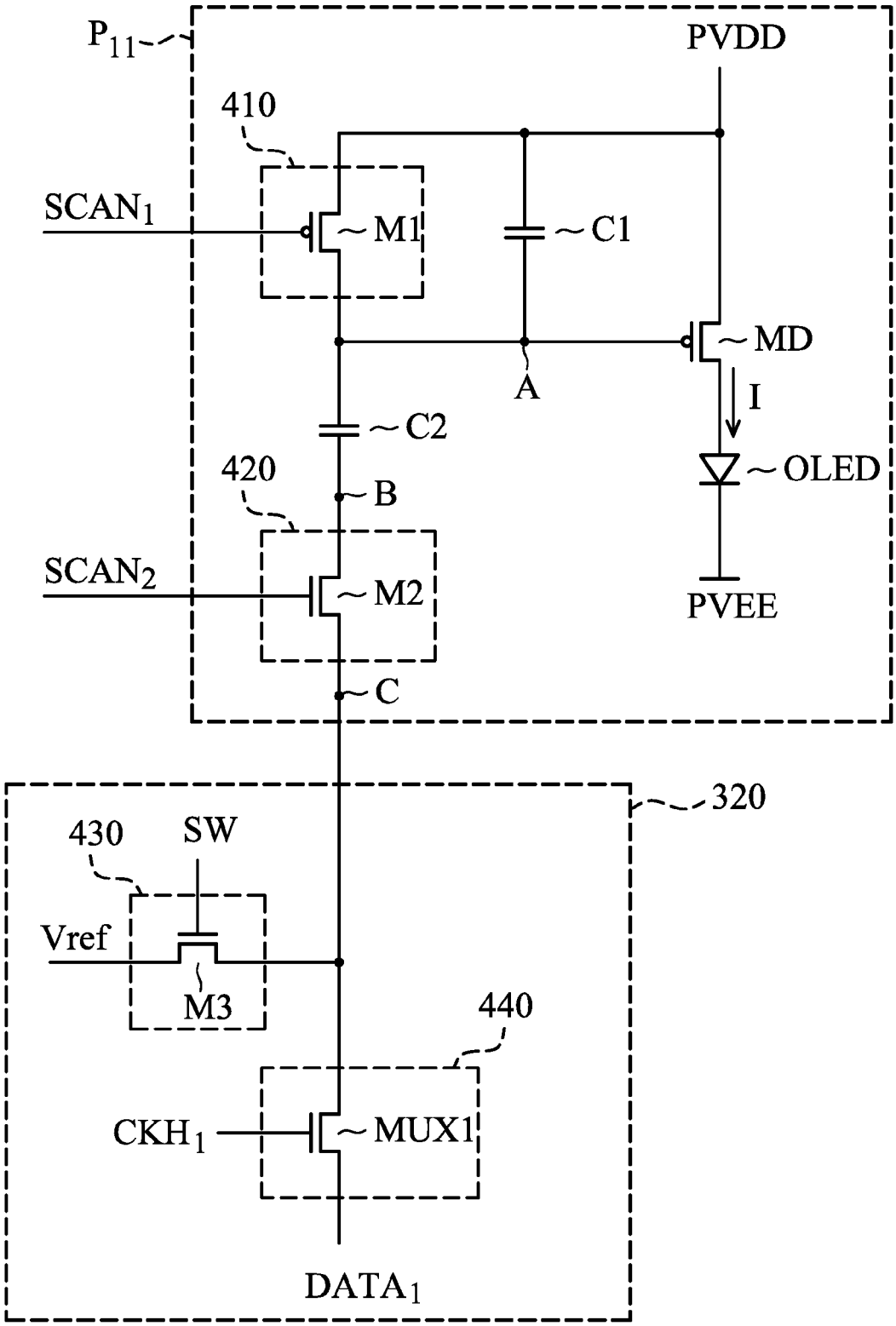
FIG. 4*a* is a schematic diagram of an exemplary embodiment of the pixel unit and the source driver shown in FIG. 3*a;*

FIG. 4*a* is a schematic diagram of an exemplary embodiment of the pixel unit $P_{11}$ and the source driver 320 shown in FIG. 3*a*. Since the structures of the pixel units $P_{11}$~$P_{mn}$ are the same, the pixel unit $P_{11}$ is given as an example. As shown in FIG. 4*a*, the pixel unit $P_{11}$ comprises switches 410 and 420, capacitors C1 and C2, a driving transistor MD, and a luminiferous device OLED. A first control terminal of the switch 410 receives the scan signal $SCAN_1$ and a first terminal of the switch 410 receives the operation voltage PVDD. A second control of the switch 420 receives the scan signal $SCAN_2$ and a fourth terminal (the node C) of the switch 420 is coupled to the source driver 320. The capacitor C1 is coupled between the first and the second terminals of the switch 410. The capacitor C2 is coupled between the second terminal (the node A) of the switch 410 and a third terminal (the node B) of the switch 420. The driving transistor MD is a P-type transistor comprising a gate coupled to the second terminal of the switch 410 and a source receiving the operation voltage PVDD. The luminiferous device OLED is coupled to a drain of the driving transistor MD and receives the operation voltage PVEE.

In this embodiment, the switch 410 is a P-type transistor M1 and the switch 420 is an N-type transistor M2. The gate of the P-type transistor M1 is served as the first control terminal of the switch 410, the source of the P-type transistor M1 is served as the first terminal of the switch 410, and the drain of the P-type transistor M1 is served as the second terminal of the switch 410. The gate of the N-type transistor M2 is served as the second control terminal of the switch 420, the drain of the N-type transistor M2 is served as the third terminal (the node B) of the switch 420, and the source of the N-type transistor M2 is served as the fourth terminal (the node C) of the switch 420. In other embodiments, the switch 410 is an N-type transistor and the switch 420 is a P-type transistor.

Additionally, the source driver 320 comprises a plurality of switches and multiplexers. Each data line is coupled to the corresponding switch (such as 430) and multiplexer (such as 440). For clarity, one switch and one multiplexer are shown in FIG. 4*a*. The source driver 320 comprises a switch 430 and a multiplexer 440. The switch 430 transmits the reference signal Vref to the fourth terminal (node C) of the switch 420 according to the switching signal SW. The multiplexer 440 transmits the data signal $DATA_1$ to the fourth terminal (node C) of the switch 420 according to the clock signal $CKH_1$. In this embodiment, the switch 430 is an N-type transistor M3 and the multiplexer 440 is an N-type transistor MUX1.

Figure 4B:
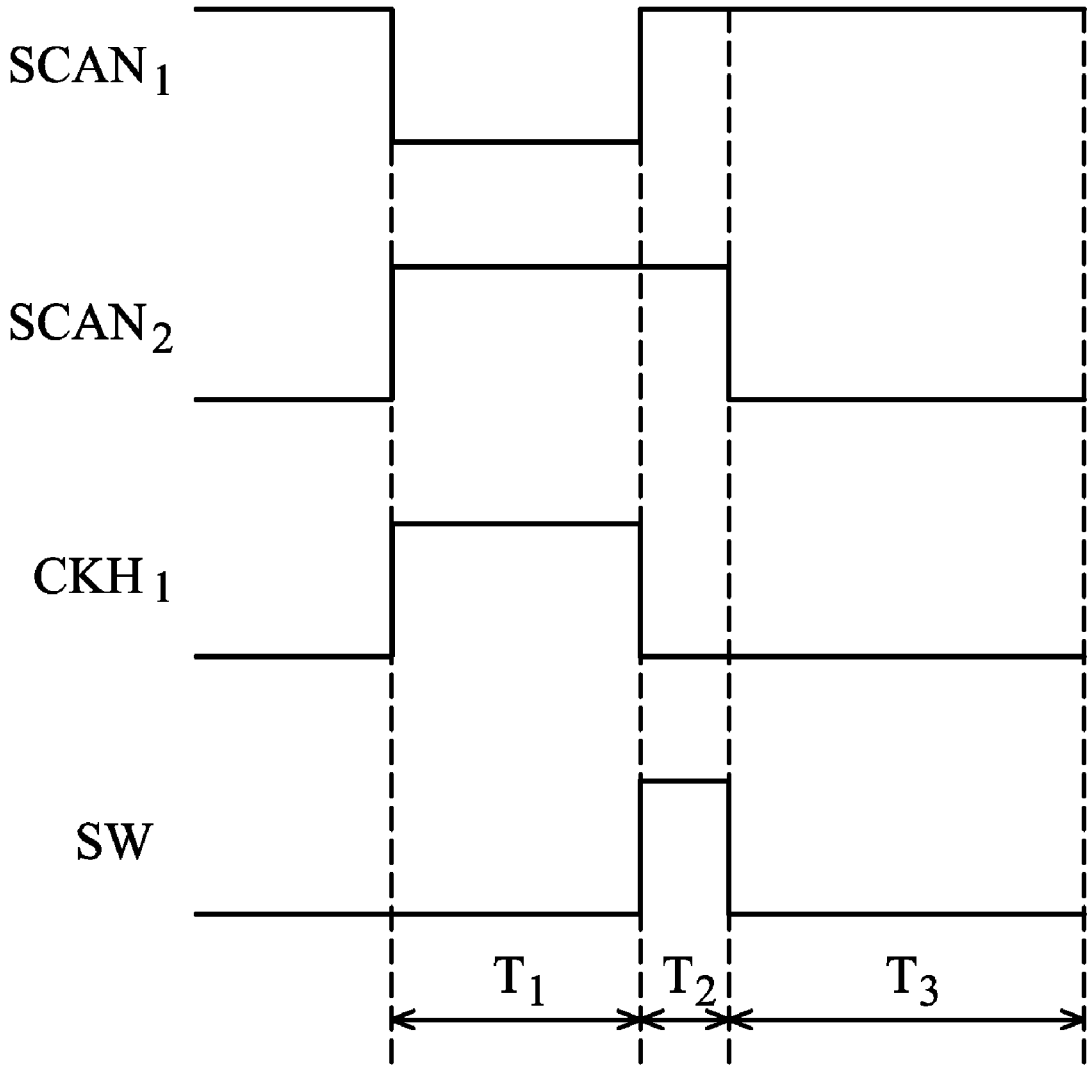
FIG. 4*b* is a timing chart of the FIG. 4*a;*

FIG. 4*b* is a timing chart of the FIG. 4*a*. Referring to FIG. 4*a*, during the period $T_1$, the scan signal $SCAN_1$ is at a low level. Thus, the switch 410 is turned on. At this time, the scan signal $SCAN_2$ is at a high level such that the switch 420 is turned on. Since the clock signal $CKH_1$ is at the high level, the multiplexer 440 transmits the data signal $DATA_1$ to the fourth terminal (node C) of the switch 420. The switches 410 and 420 are turned on, the node A is capable of receiving the operation voltage PVDD and the node B is capable of receiving the data signal $DATA_1$.

During the period $T_2$, the scan signal $SCAN_1$ is at the high level such that the switch 410 is turned off. At this time, the scan signal $SCAN_2$ is continuously at the high level, the switch 420 is continuously turned on. Since the clock signal $CKH_1$ is at the low level, the multiplexer 440 is turned off. The switching signal SW is at the high level such that the switch 430 is turned on. Since the switches 420 and 430 are turned on, the node B is capable of receiving the reference signal Vref. Since the switch 410 is turned off, the level of the node A is floating. According to the characteristic of the capacitor, the voltage $V_A$ of the node A is expressed by the following equation (1):

$$V_A = PVDD - (DATA_1 - Vref) \times \frac{C2}{C1 + C2} \quad \text{Equation (1)}$$

During the period $T_3$, the scan signal $SCAN_1$ is continuously at the high level. Thus, the switch 410 is turned off. At this time, the level of the scan signal $SCAN_2$ is changed to the low level. Thus, the switch 420 is turned off. The clock signal $CKH_1$ and the switching signal SW are at the low level such that the multiplexer 440 and the switch 430 are turned off. Since the switches 410 and 420 are turned off, the level of the nodes A and B are floating. The current I passing through the driving transistor MD is expressed by the following equation (2):

$$I = k_p \times (V_{SG} - |V_{th}|)^2 \quad \text{Equation (2)}$$

Equation (1) is to substitute equation (2) and the substituted result is expressed by the following equation (3):

$$I = k_p \times \left\{ PVDD - \left[ \begin{matrix} PVDD - (DATA_1 - Vref) \times \\ \frac{C2}{C1 + C2} \end{matrix} \right] - |V_{th}| \right\}^2 \quad \text{Equation (3)}$$

Equation (3) is simplified and the simplified result is expressed by the following equation (4):

$$I = k_p \times \left[ (DATA_1 - Vref) \times \frac{C2}{C1 + C2} \right] - |V_{th}| \Big\}^2 \quad \text{Equation (4)}$$

As recited in equation (4), the current I passing through the driving transistor MD does not relate to the operation voltage PVDD. Since the luminiferous device 140 is lighted according to the current I, when the operation voltage PVDD is shifted, the current I does not be affected.

Figure 5A:
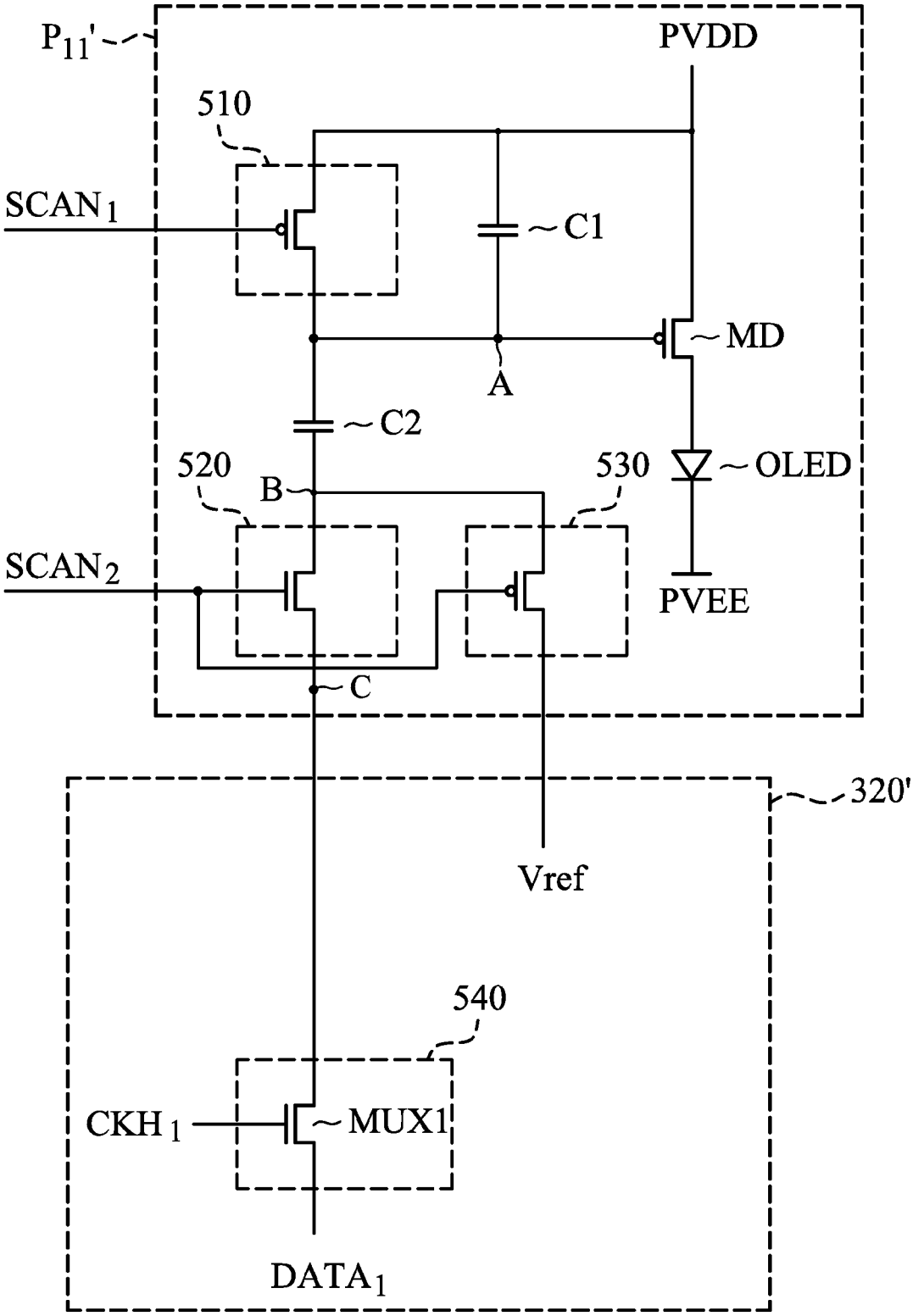
FIG. 5*a* is a schematic diagram of another exemplary embodiment of the pixel unit and the source driver shown in FIG. 3*a*.

FIG. 5*a* is a schematic diagram of another exemplary embodiment of the pixel unit and the source driver shown in FIG. 3*a*. The pixel unit $P_{11}$' utilizes two metal lines to receive the data signal $DATA_1$ and the reference signal Vref. As shown in FIG. 5*a*, the pixel unit $P_{11}$' comprises switches 510, 520, and 530, capacitors C1 and C2, a driving transistor MD, and a luminiferous device OLED. The switch 530 transmits the reference signal Vref to the node B according to the scan signal $SCAN_2$. In this embodiment, the switch 520 is an N-type transistor and the switch 530 is a P-type transistor. In some embodiments, the switch 520 is a P-type transistor and the switch 530 is an N-type transistor.

Since FIG. 5*a* shows the connection relation between switches 510, 520, and 530, capacitors C1 and C2, a driving transistor MD, and a luminiferous device OLED, the description of the connection relation is omitted for brevity. Additionally, in this embodiment, the source driver 320' comprises a multiplexer 540. The multiplexer 540 transmits the data signal $DATA_1$ to the node C according to the clock signal $CKH_1$.

Figure 5B:
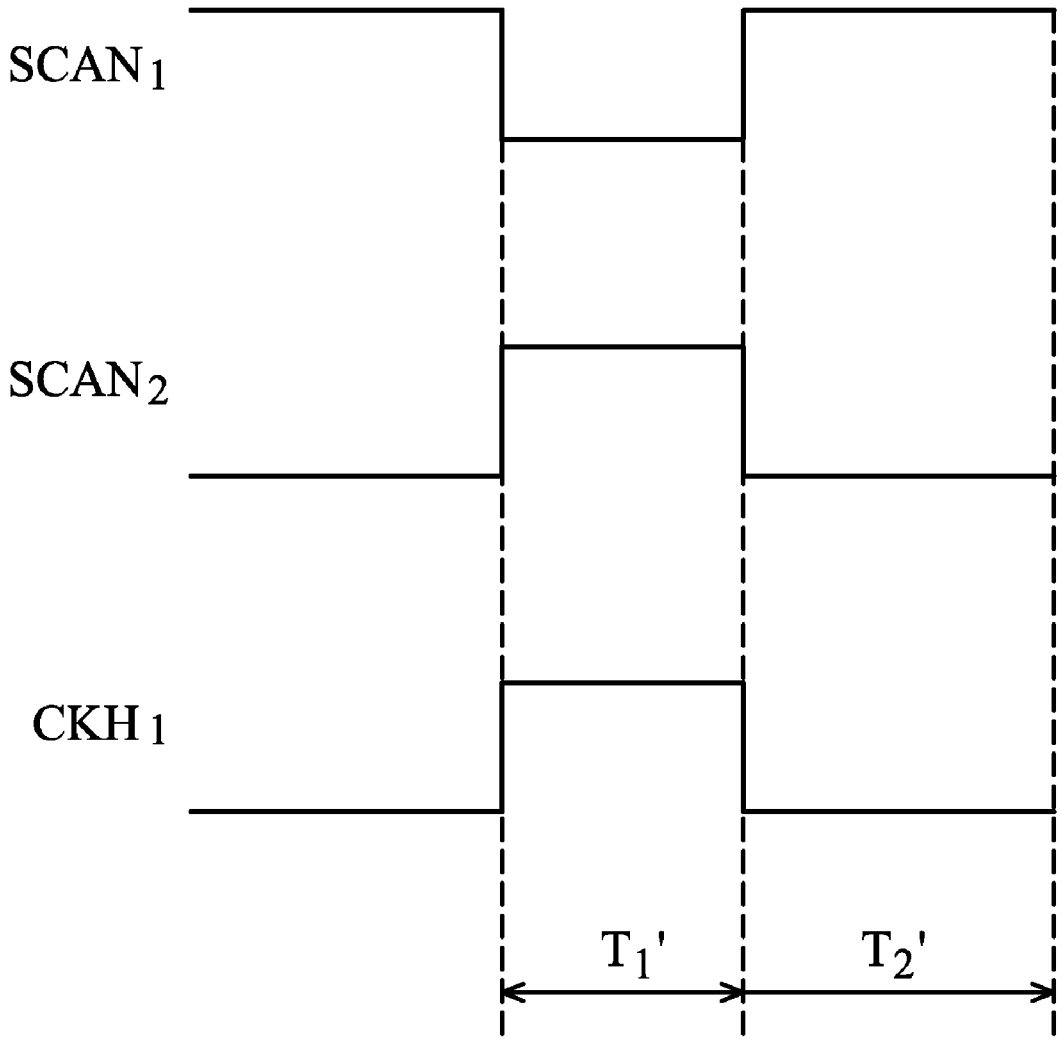
FIG. 5*b* is a timing chart of the FIG. 5*a*.

FIG. 5*b* is a timing chart of the FIG. 5*a*. Referring to FIG. 5*a*, during the period $T_1$', the scan signal $SCAN_1$ is at the low level. Thus, the switch 510 is turned on. The scan signal $SCAN_2$ is at the high level. Thus, the switch 520 is turned on and the switch 530 is turned off. The clock signal $CKH_1$ is at the high level such that the multiplexer 540 transmits the data signal $DATA_1$ to the node C. Since the switches 510 and 520 are turned on, the node A receives the operation voltage PVDD and the node B receives the data signal $DATA_1$.

During the period $T_2$', the scan signal $SCAN_1$ is at the high level such that the switch 510 is turned off. The scan signal $SCAN_2$ is at the low level. Thus, the switch 520 is turned off and the switch 530 is turned on. The clock signal $CKH_1$ is at the low level such that the multiplexer 540 stops transmitting the data signal $DATA_1$. Since the switch 510 is turned off, the level of the node A is floating. The switch 530 is turned on such that the node B receives the reference signal Vref. At this time, the voltage of the node A is expressed in equation (1). The current I passing through the driving transistor MD is expressed in equation (4). As recited in equation (4), the current I passing through the driving transistor MD does not relate to the operation voltage PVDD. Thus, the luminiferous device OLED is not affected by the operation voltage PVDD.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A system for displaying images, comprising:

a display panel, comprising:

a gate driver providing a first scan signal and a second scan signal; and a source driver providing a data signal during a first period, providing a reference signal during a second period, and comprising:

a data unit providing the data signal; and a control unit providing the reference signal and a clock signal; and a pixel unit coupled to the source driver, comprising:

a first switch comprising a first control terminal receiving the first scan signal, a first terminal directly receiving a first operation voltage, and a second terminal;

a switch module transmitting the data signal according to the second scan signal during the first period and transmitting the reference signal according to the second scan signal during the second period;

a first capacitor coupled between the first and the second terminals;

a second capacitor directly coupled between the second terminal and the switch module;

a driving transistor comprising a gate coupled to the second terminal, a source receiving the first operation voltage, and a drain; and a luminiferous device coupled to the drain and receiving a second operation voltage.

2. The system as claimed in claim 1, wherein the switch module comprises a second switch comprising a second control terminal receiving the second scan signal, a third terminal, and a fourth terminal coupled to the source driver.

3. The system as claimed in claim 2, wherein the first switch is a P-type transistor and the second switch is an N-type transistor.

4. The system as claimed in claim 2, wherein the first switch is an N-type transistor and the second switch is a P-type transistor.

5. The system as claimed in claim 2, wherein during the first period, the first switch is turned on by the first scan signal, the second terminal receives the first operation voltage, the second switch is turned on by the second scan signal, and the source driver provides the data signal to the fourth terminal.

6. The system as claimed in claim 5, wherein during the second period, the first switch is turned off by the first scan signal, the second switch is continuously turned on by the second scan signal, and the source driver provides the reference signal to the fourth terminal.

7. The system as claimed in claim 6, wherein during a third period, the first switch is turned off by the first scan signal and the second switch is turned off by the second scan signal.

8. The system as claimed in claim 2, further comprising: a third switch, wherein the third switch comprises a fourth control terminal coupled to the second control terminal, a fifth terminal coupled to the third terminal, and a sixth terminal coupled to the source driver.

9. The system as claimed in claim 8, wherein the second switch is an N-type transistor and the third switch is a P-type transistor.

10. The system as claimed in claim 7, wherein the second switch is a P-type transistor and the third switch is an N-type transistor.

11. The system as claimed in claim 8, wherein during the first period, the first switch is turned on by the first scan signal, the second switch is turned on by the second scan signal, the third switch is turned off by the second scan signal, and the source driver provides the data signal to the fourth terminal.

12. The system as claimed in claim 11, wherein during the second period, the first switch is turned off by the first scan signal, the second switch is turned off by the second scan signal, the third switch is turned on by the second scan signal, and the source driver provides the reference signal to the third terminal.

13. The system as claimed in claim 1, further comprising a power transformation module transforming an external power into the first operation voltage and the second operation voltage, wherein the display panel receives the first operation voltage and the second operation voltage.

14. The system as claimed in claim 13, wherein the system is a personal digital assistant (PDA), a cellular phone, a digital camera (DSC), a television, a global positioning system (GPS), a car display, an avionics display, a digital photo frame, a notebook computer (NB), or a personal computer (PC).

15. The system as claimed in claim 1, wherein the source driver provides the data signal via a data line during the first period and provides the reference signal via the data line during the second period.

16. The system as claimed in claim 1, wherein the source driver provides the data signal via a first data line during the first period and provides the reference signal via a second data line during the second period.

* * * * *